United States Patent [19]

Pringle

[11] 4,274,186

[45] Jun. 23, 1981

[54] HEAT EXCHANGER

[75] Inventor: William L. Pringle, Grosse Pointe Shores, Mich.

[73] Assignee: United States Steel Corporation, Pittsburgh, Pa.

[21] Appl. No.: 80,241

[22] Filed: Oct. 1, 1979

Related U.S. Application Data

[62] Division of Ser. No. 910,129, May 26, 1978, abandoned.

[51] Int. Cl.[3] ..... B23P 15/26

[52] U.S. Cl. ..... 29/157.3 D; 113/118 D; 165/172; 165/183

[58] Field of Search ..... 29/157.3 R, 157.3 A, 29/157.3 B, 157.3 C, 157.3 D; 113/118 A, 118 B, 118 D; 165/172, 176, 183, 151

[56] References Cited

U.S. PATENT DOCUMENTS

| | | | |
|---|---|---|---|
| 844,685 | 2/1907 | Long | 113/118 A |
| 2,137,044 | 11/1938 | Dawson | 29/157.3 R |
| 2,999,305 | 9/1961 | Reynolds | 29/157.3 R |
| 3,425,113 | 2/1969 | Ward, Jr. | 29/157.3 X |
| 3,559,264 | 2/1971 | Bracken, Jr. | 29/157.3 R |
| 3,702,632 | 11/1972 | Grimshaw | 29/157.3 R |

FOREIGN PATENT DOCUMENTS

| | | | |
|---|---|---|---|
| 1225866 | 2/1960 | France | 29/157.3 A |

*Primary Examiner*—Nicholas P. Godici
*Assistant Examiner*—V. K. Rising
*Attorney, Agent, or Firm*—McGlynn and Milton

[57] ABSTRACT

A heat exchanger assembly and method for making the assembly. The assembly includes a pair of plates having longitudinal grooves which are joined together with the grooves mating with each other to define fluid-carrying channels extending between the ends of the plates for receiving a heat exchange fluid. The plates include an engaging intermediate surface between certain channels and the fluid-carrying channel passages may be arranged in groups having a laterally spaced relationship from each other. Header means having orifices for connection to the fluid-carrying channels are at each end of the plates for providing a continuous closed path. The plates and channels are coiled to extend about and around one of the header means which provides a circular configuration. The grooves in one of the plates include bosses for providing self-spacing of adjacent convolutions of the channels and plates. Additionally, there is disclosed a method of making the above-described heat exchanger assembly including the steps of rolling longitudinal grooves in a pair of plates on a common mill and forming intermittent bosses in one of the plates, crossing over the plates and mating the longitudinal grooves to define fluid-carrying channels, simultaneously seam welding the plates together, dipping in a plating solution, cutting to a desired length, joining the channels at each end of the plates to a header means, and coiling the plates and channels by bending transversely to the longitudinal extent to extend the plates and channels about and around one of the header means to provide overlying convolutions of the plates and channels.

3 Claims, 5 Drawing Figures

HEAT EXCHANGER

This application is a divisional of application Ser. No. 910,129, filed May 26, 1978 and now abandoned.

BACKGROUND OF THE INVENTION (1) Field of the Invention

The subject invention relates to an improved heat exchanger wherein heat is transferred between heat exchange fluids which are separated by a thermally conductive wall. As part of an evaporator-condenser system, a heat exchange fluid is changed from the vapor phase to the liquid phase and gives off heat in the process. Such systems are used in air conditioners, refrigerators, freezers and the like. Among the many other applications of heat exchangers are cooling engine lubricating oil, radiators, and any other application where effective transfer of heat among two or more fluids is required.

(2) Description of the Prior Art

Typically, the prior art heat exchanger assemblies of the plate type are formed by longitudinal grooves or embossments in plate members which are mated together; however, the fluid channel passages of the prior art heat exchanger assemblies of this type are usually stacked or may be wound in a serpentine configuration and commonly employ fins.

SUMMARY OF THE INVENTION

The subject invention relates to an improved heat exchanger assembly comprising a pair of plates having longitudinal grooves therein joined together with the grooves mating with each other to define fluid-carrying channels extending between the ends of the plates for receiving a heat exchange fluid. Header means at each of the ends of the plates provide a continuous closed path for the heat exchange fluid. The plates and channels are coiled to extend about and around one of the header means.

Additionally, there is disclosed a method of making a heat exchanger assembly including the steps of; rolling longitudinal grooves in a pair of plates on a mill, aligning the plates and mating the longitudinal grooves to define fluid-carrying channels, and simultaneously seam welding the plates together along engaging surfaces of the plates.

PRIOR ART STATEMENT

Typical of a heat exchanger assembly of the type to which the instant invention pertains is that shown in U.S. Pat. No. 3,712,372 granted to L. J. Tranel on Jan. 23, 1973. This patent discloses a plate-type heat exchanger wherein the plates form a continuous strip of tubing for receiving a heat exchange fluid and flat-type fin stock is bonded to the plates for heat exchanger applications. The continuous strip of plates and tubing in this patent, however, teaches employing tubing which is deformed flat in parts and undeformed in other parts and is wound in a serpentine configuration.

U.S. Pat. No. 3,759,323 granted on Sept. 18, 1973 to H. J. Dawson et al discloses a plate-type heat exchanger employing thimbles or bosses in sheets which provide support and spacing. The fluid channel passages disclosed in this patent, however, define a C-shaped flow path for heat exchange fluids.

Thus, neither of these patents disclose plates which are joined together to form channels being coiled to extend about and around one of the header means. Additionally, neither of the patents discussed above disclose a method of making a heat exchanger by rolling longitudinal grooves in a pair of plates, aligning the plates with the grooves mating to define fluid-carrying channels, and simultaneously seam welding the plates together along engaging surfaces of the plates.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
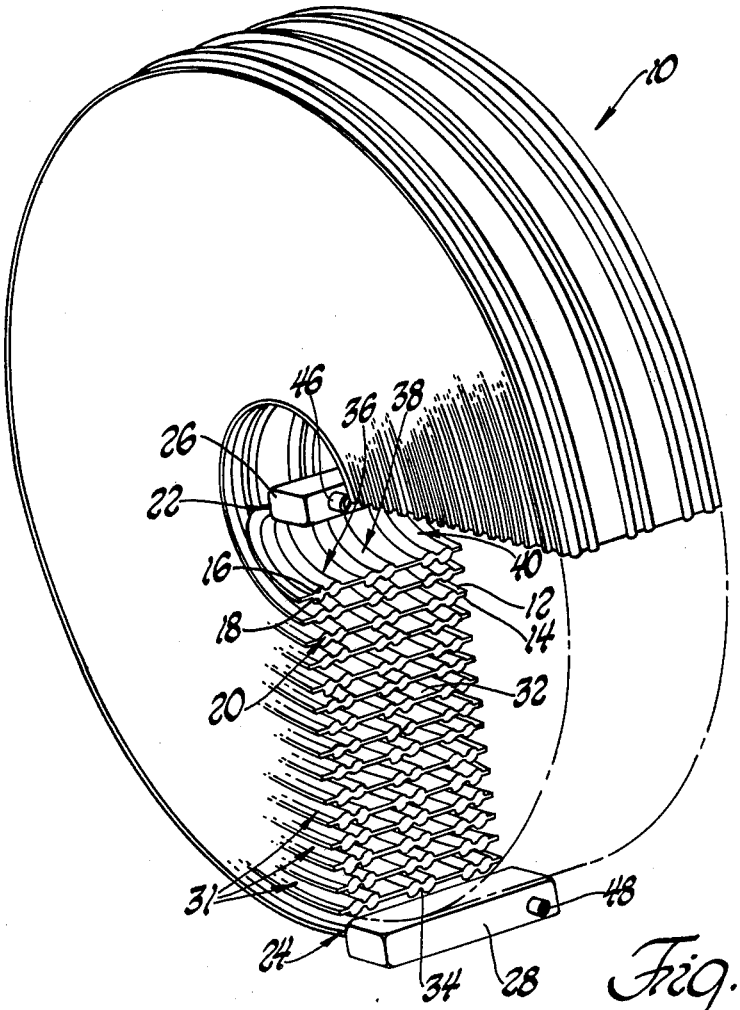
FIG. 1 is a perspective view partially broken away of a heat exchanger assembly constructed in accordance with the instant invention.
Figure 2:
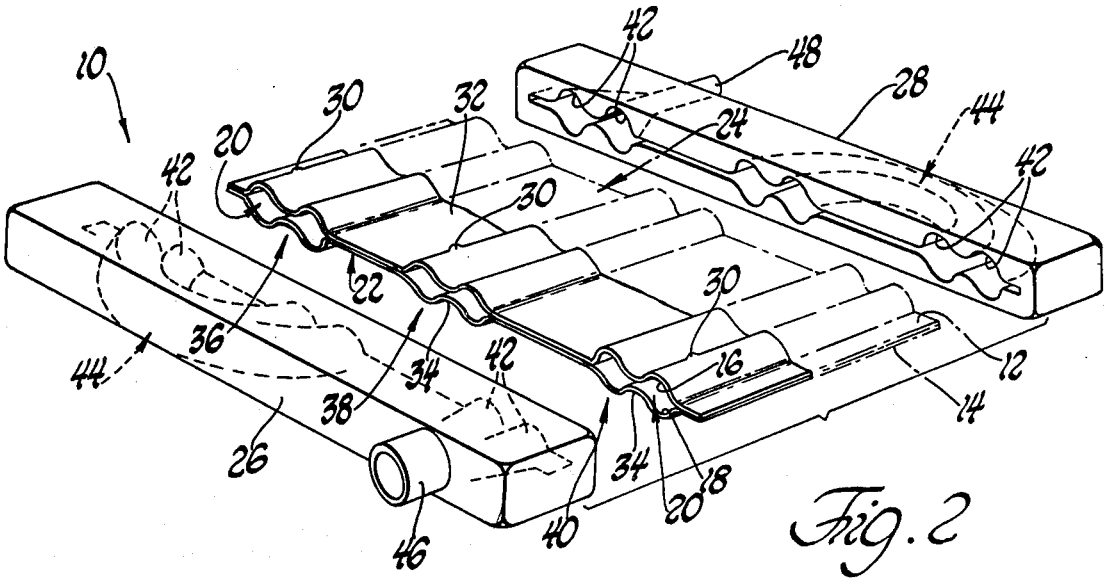
FIG. 2 is an expanded perspective view of the components shown in FIG. 1 revealing one step in the method of making a heat exchanger assembly constructed in accordance with the instant invention.
Figure 3:
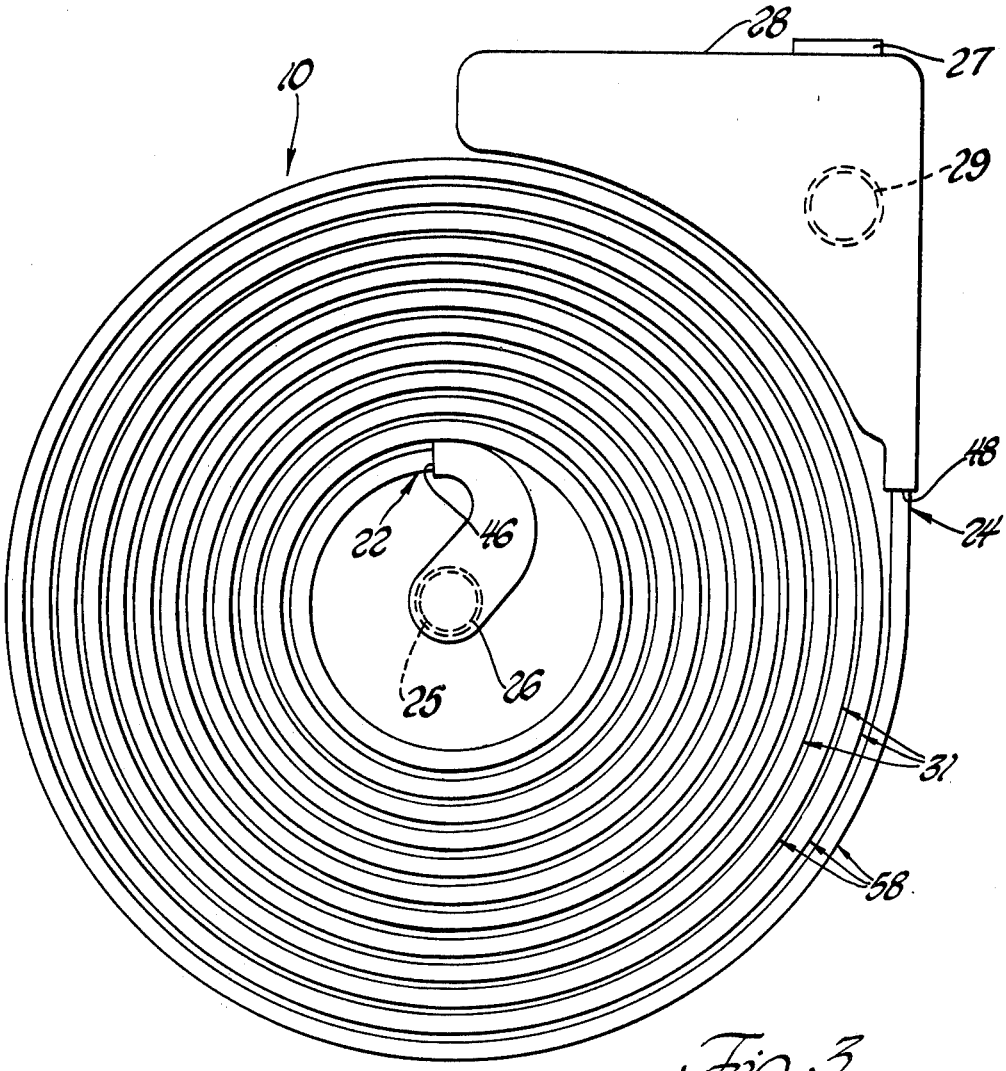
FIG. 3 is an elevational view illustrating another embodiment of the instant invention.

A heat exchanger assembly constructed in accordance with the instant invention is generally shown at 10. Referring to FIGS. 1 and 2, the assembly 10 includes a pair of plates 12 and 14 having respective longitudinal grooves 16 and 18 which are joined together with the grooves 16 and 18 mating with each other to define fluid-carrying channels generally indicated at 20 which extend between the ends generally indicated at 22 and 24 of the plates 12 and 14 for receiving a heat exchange fluid. A header means 26 is at one end 22 of the plates 12 and 14 while another header means 28 is at the other end 24 of the plates 12 and 14 in order to provide a continuous closed path for the heat exchange fluid. The header means 26 and 28 provide a continuous closed path for the heat exchange fluid through the channels 20 which may either reverse flow from one passage to another or allow the flow to be in one direction without reversing flow. The plates 12 and 14 and the channels 20 formed thereby are coiled to extend about and around one of the header means 26. In other words, as best seen in FIGS. 1 and 3, the coiled plates 12 and 14 which form the fluid-carrying channels 20 have a circular configuration.

As best seen in FIG. 2, the grooves 16 in one of the plates 12 have bosses or embossed thimbles 30 which provide for self-spacing of adjacent convolutions of the channels 20 which are formed by the plates 12 and 14 in the circular configuration shown in FIG. 1. The thimbles or bosses 30 provide for greater or lesser spacing of the convolutions depending upon the size of the thimbles or bosses 30. Thus, when the assembly 10 shown in FIG. 1 is associated with a fan, the spacing, generally indicated at 31, between the convolutions may be adjusted to allow more or less air to flow through. Additionally, the bosses 30 eliminate the necessity for fins which most other heat exchangers require. In the same vein, the round or circular configuration shown in FIG.

1 would take full advantage of a blower or fan efficiency and the round or circular design of the assembly 10 reduces the size of the entire unit. Thus, the assembly 10 would provide many advantages when used with an evaporator or condenser system, radiator system and many other heat exchanger applications.

Figure 4:
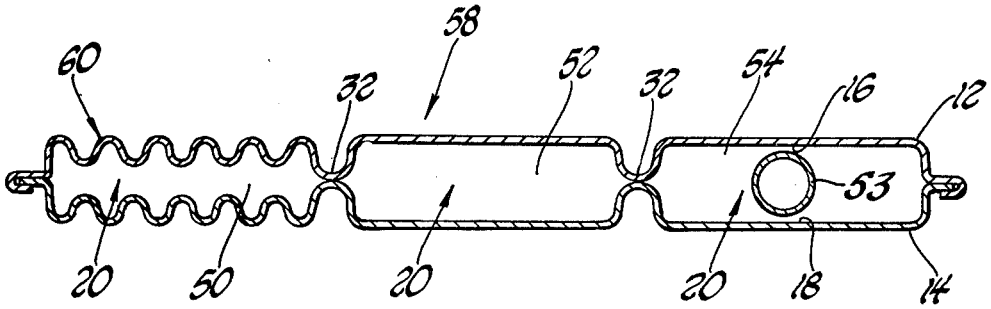
FIG. 4 is a cross-sectional view illustrating certain components of FIG. 3.

Referring to FIGS. 1, 2, and 4, the plates 12 and 14 include an engaging intermediate surface 32 of the plates 12 and 14 between certain fluid-carrying channels 20 where the plates 12 and 14 may be seam welded together. Referring to FIGS. 1 and 2, the fluid-carrying channels 20 may be arranged in groups with at least two channels 20 in each of the groups and the groups have a laterally spaced relationship with an adjacent group of channels 20.

In the embodiment shown in FIGS. 1 and 2, the fluid-carrying channels 20 defining each of the above-mentioned groups may communicate with each other within each of said groups. In other words, the depth of the crests 34 which provide the paired configuration of the channels 20, is shallower than the grooves 16 or 18 so that each channel 20 of the pairs or twins may communicate with each other to form twin passageways or passageways generally shown at 36, 38 and 40. Thus, in the embodiment shown in FIGS. 1 and 2, there are actually only three passageways or twin passageways 36, 38 and 40 rather than six passageways as would be the case if each channel 20 in the pairs or twins did not communicate. The lateral spacing of the twin passageways 36, 38 and 40 of the pairs of channels 20 faciliates the coiling of the plates 12 and 14 since the less that metal is deformed, the easier it bends.

As shown in FIG. 2, the header means 26 and 28 include orifices 42 for connecting the header means 26 and 28 to the fluid-carrying channels 20. Passages shown in phantom and generally indicated at 44 extend from the orifices 42 and through the header means 26 and 28 in order to interconnect each group of channels 20 with an adjacent group of channels 20. As alluded to above, each header means 26 and 28 may be associated with or a part of an evaporator-condenser system. By way of illustration, if the header means 26 is employed as the manifold of a condenser with a liquid outlet 46 while the header means 28 is employed as the manifold of an evaporator system with a capillary end or gas inlet 48, a droplet or the heat exchange fluid must pass through every passage 36, 38 and 40 before getting out. In other words, the manifold or header means 26 and 28 reverse flow from one twin passage, e.g. 38, to the next twin passage, e.g. 40, which allows for the heat exchange fluid to travel a great distance while being exposed to a cooling medium such as air from a fan or blower which circulates through the space 31 between adjacent convolutions. It is also possible, however, that when employed with a radiator system, there will be flow through all three passages 36, 38 and 40 simultaneously, as will be further described hereinafter.

Referring to FIG. 4, the fluid-carrying channels 20 which define each of the groups may be separated from each other whereby each of the fluid-carrying channels 20 define a distinct channel which may receive a different heat exchange fluid. In the embodiment illustrated in FIGS. 3 and 4, the instant assembly 10 may be used as a combination heat exchanger. In other words, each of the fluid-carrying channels 20 may contain a different heat exchange fluid. By way of illustration, referring to FIG. 4, each channel 20 may form a distinct passageway 50, 52 and 54 to form a combination passageway generally indicated at 58 which is capable of carrying and allowing heat exchange between a number of different heat exchange fluids. Thus, when associated with an engine cooling system, oil may flow through passageway 50, water through passageway 52, and a refrigerant such as Freon through passageway 54. It is noted, however, that with the embodiment illustrated in FIGS. 3 and 4, the assembly may still have a coiled configuration in order to allow maximum efficiency for moving air through the spaces 31 from a fan or blower.

In the embodiment shown in FIGS. 3 and 4, a tube may be associated with or within any of the channels 50, 52 or 54 of the combination passageway 58 in order to carry a heat exchange fluid such as Freon or oil while the passageway associated with the tube may contain water in order to allow heat transfer between these fluids. Such an application is shown in FIG. 4 wherein an interior tube 53 which may convey oil from an engine is inside the channel 54 which may convey water to cool the oil. It is also shown in FIG. 4, that some or all of the fluid-carrying channels 20 may be corrugated as indicated at 60 in order to provide more surface area for increased heat exchange and to increase turbulence.

As alluded to above, when the subject assembly 10 is employed as a radiator for an engine cooling system, the flow through the passages 20 will be in one direction. In other words, the header passages 44 shown in FIG. 2 which reverse flow of fluid from one passage 20 to another passage 20, would be eliminated. Thus, the fluids will all flow in one direction; i.e., from header means 28 to header means 26. Referring to FIG. 3, the header means 28 and 26 tie all three passages 50, 52 and 54 together. The manifold or header 28 has a filler tube 27 for receiving a heat exchange fluid, such as water, and an inlet 29 for receiving a fluid, such as oil, from an engine. The manifold or header 26 has an outer tube 25 to return oil which has been cooled back to the engine. The oil may flow through certain of the passages 20 or through a tube 53. In short, the passages 20 may be adapted to have variable paths for a combination radiator, oil cooler and condenser.

Referring to the drawings generally, a heat exchanger constructed in accordance with the instant invention is particularly adapted to using steel for construction of the assembly 10. This will provide good heat exchange, will hold a heavy load, withstand pressures and be adapted to seam welding on a continuous basis.

Figure 5:
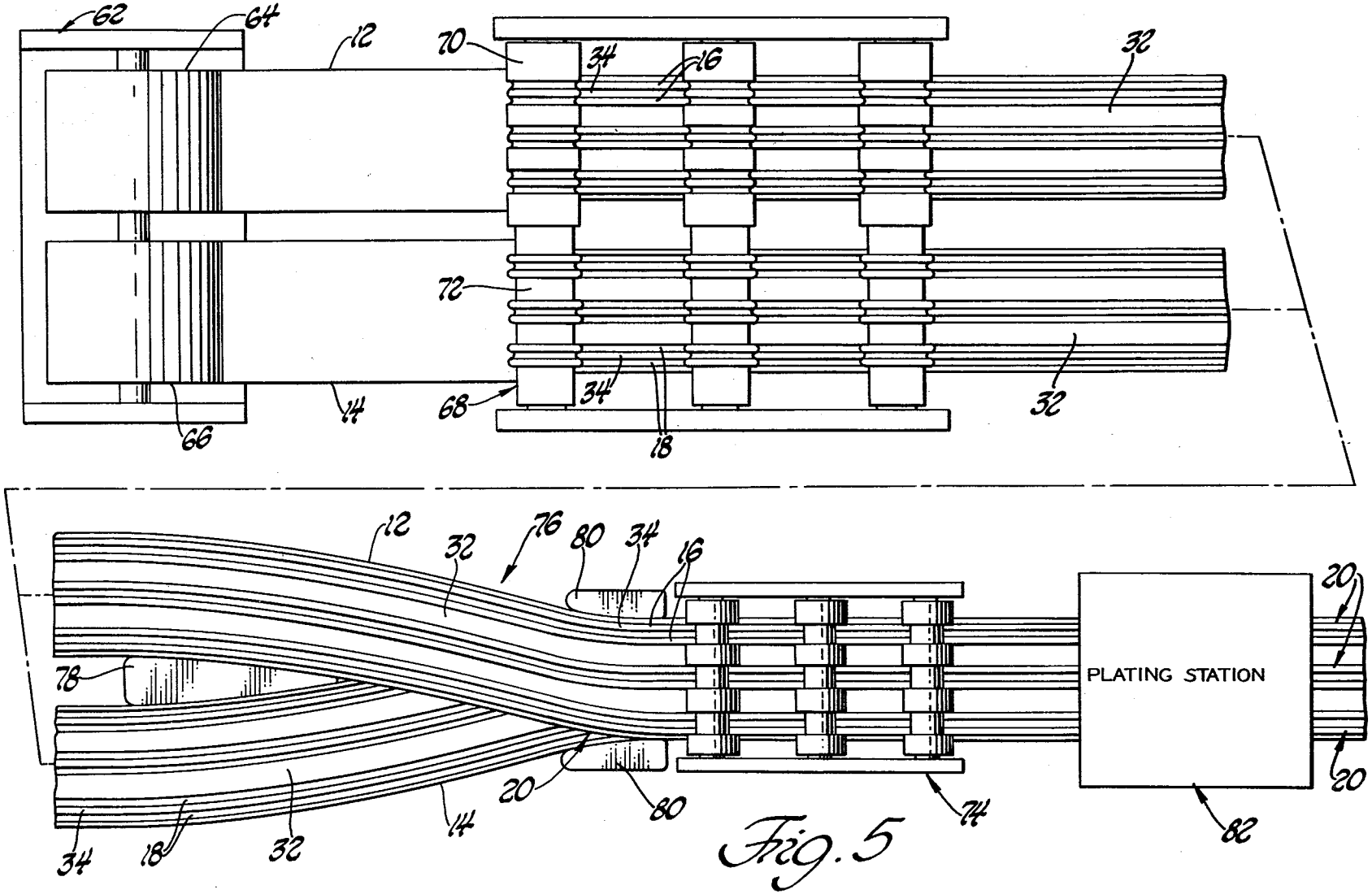
FIG. 5 is a plan view illustrating various steps in the method of making heat exchanger assembly constructed in accordance with the instant invention.

Turning now to a method of making the subject heat exchanger assembly 10 and referring to FIG. 5, the plates or strips of metal may be stored on a spindle generally indicated at 62 with one spool or coil 64 providing the plate 12 while another spool or coil 66 provides plate 14.

The method of making a heat exchanger assembly 10 includes the step of rolling the longitudinal grooves 16 and 18 in a pair of plates 12 and 14 on a mill generally indicated at 68. This step is further defined as rolling the longitudinal grooves 16 and 18 in the pair of plates 12 and 14 on a mill 68 wherein the mill 68 is a common mill having a male roller 70 and a female roller 72. The method also includes the steps of aligning the plates 12 and 14 and mating the longitudinal grooves 16 and 18 to define the fluid-carrying channels 20, and simultaneously seam welding the plates together along their engaging surfaces 32 by a seam welder generally indicated at 74. More specifically, the longitudinal grooves 16 and 18 may be rolled in the pair of plates 12 and 14 on a common mill 68 and thereafter crossing over, as indicated at 76, the plates 12 and 14 by guide members 78 and 80 to allow the plates 12 and 14 to be aligned with the grooves 16 and 18 mating to define fluid-carrying channels 20.

The method further includes the steps of dipping the plates 12 and 14 in a plating solution generally indicated at 82 to galvanize the plates 12 and 14, then cutting the plates 12 and 14 which form the fluid-carrying channels 20 to a desired length, and joining the ends formed from cutting each of the plates 12 and 14 to a header means 26 and 28 for providing a continuous closed path. The plates 12 and 14 and the channels 20 formed thereby are then coiled by bending transversely to the longitudinal extent to extend the plates 12 and 14 and the channels 20 about and around one of the header means 26 to provide overlying convolutions of the plates 12 and 14 and the channels 20.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A method of making a heat exchanger assembly including the steps of; rolling longitudinal grooves in a pair of plates on a common mill, aligning the plates and mating the longitudinal grooves to define fluid-carrying channels by crossing over the plates to allow the plates to be aligned with the grooves mating to define fluid-carrying channels and simultaneously seam-welding the plates together along engaging surfaces of the plates.

2. A method as set forth in claim 1 including the step of forming intermittent bosses in the grooves in one of the plates.

3. A method as set forth in claim 1 including the steps of dipping the plates in a plating solution to galvanize the plates, cutting the plates to a desired length, joining the channels at each end of the plates to a header means for providing a continuous closed path, and coiling the plates and channels by bending transversely to the longitudinal grooves to extend the plates and channels about and around one of the header means to provide overlying convolutions of the plates and channels.

* * * * *